United States Patent [19]

Holman

[11] Patent Number: 4,921,274

[45] Date of Patent: May 1, 1990

[54] SKI SEAT STRUCTURE

[76] Inventor: Daniel R. Holman, 3435 Duncan Ave. NE., Salem, Oreg. 97303

[21] Appl. No.: 313,039

[22] Filed: Feb. 21, 1989

[51] Int. Cl.[5] ..... A63C 11/00

[52] U.S. Cl. ..... 280/812

[58] Field of Search ..... 280/812, 820, 14.1, 280/816, 28.14, 28.15

[56] References Cited

U.S. PATENT DOCUMENTS

| | | | |
|---|---|---|---|
| 2,367,271 | 1/1945 | Habostad | 280/14.1 |
| 2,709,603 | 5/1955 | Osmun | 280/812 |
| 2,834,604 | 5/1958 | Osmun | 280/812 |
| 3,902,731 | 9/1975 | Fagen et al. | 280/812 |
| 3,976,304 | 8/1976 | Lillibridge et al. | 280/813 |
| 4,130,294 | 12/1978 | Walker | 248/155.1 |
| 4,456,284 | 6/1984 | Saka | 280/812 |
| 4,786,082 | 11/1988 | Swietlik | 280/812 |

FOREIGN PATENT DOCUMENTS

| | | | |
|---|---|---|---|
| 144692 | 2/1936 | Austria | 280/14.1 |

*Primary Examiner*—Charles A. Marmor
*Assistant Examiner*—Eric Culbreth
*Attorney, Agent, or Firm*—James D. Givnan, Jr.

[57] ABSTRACT

A seat structure including a post which engages a retainer socket on the surface of a ski. A ski pole holder on the post upper end receives a horizontally disposed ski pole which also functions as a seat. Straps confine the post in parallel with the ski pole. In a modified form, the post and ski pole holder are pivotally joined with the holder attached to the ski pole.

8 Claims, 1 Drawing Sheet

SKI SEAT STRUCTURE

BACKGROUND OF THE INVENTION

The present invention concerns recreational ski equipment and particularly the modification of such equipment to provide a temporary seat.

Efforts to provide a skier a temporary seat are embodied in the structures found in U.S. Pat. Nos. 4,786,082 wherein a seat is jointly supported by a pair of ski poles; 2,834,604 and 2,709,603 wherein a seat is affixed to the upper end of a ski pole; 3,902,731 discloses a temporary seat in the nature of a sling suspended from the hand grips of a pair of corresponding ski poles; 2,445,344 which discloses a seat member in inserted endwise engagement with a pair of ski poles; 4,456,284 discloses a sling serving as a seat and having a pair of sleeves one each supported by a ski pole upper end; and 4,130,294 discloses a segmented ski pole including a collapsible seat structure. For one reason or another none of the foregoing seat structures are believed to be widely accepted by recreational skiers.

SUMMARY OF THE PRESENT INVENTION

The present invention is embodied within a seat post and cross member for supported engagement by a ski with the cross member in supporting engagement with a horizontally crosswise disposed ski pole.

The above noted patents are directed toward providing a skier means allowing brief periods of rest. Skiers, particularly in downhill skiing, benefit from brief rest periods while seated on a ski lift. For greater rest periods, it is necessary the skier rely on facilities provided by a ski lodge which detracts from time spent skiing. While several efforts have been directed toward providing temporary ski seat structures, it is still necessary, for the most part, for the skier to return to a facility for periods of rest.

The present seat structure includes a post member detachably engageable at its lower end with retainer means at the upper surface of a ski. A cross member at the post upper end has a concave surface which receives a ski pole disposed crosswise of the ski and horizontally to permit same to function as a seat component. Attachment means are provided to allow post attachment to the ski pole to permit the latter to be used in the customary manner. A socket type retainer on the ski receives the post lower end in an inserted manner. Socket installation on the ski may be by an adhesive member to avoid alteration of the ski.

Important objectives of the present invention include the provision of seat structure of uncomplicated design and readily deployed by the skier as well as conveniently stowed at the end of a rest period; the provision of a seat structure of low cost manufacture yet of reliable operation to withstand the severe treatment encountered by ski equipment. These and other objectives will become apparent upon the understanding of the following description of the seat structure.

DETAILED DESCRIPTION OF THE PREFERRED EMBODIMENTS

Figure 1:
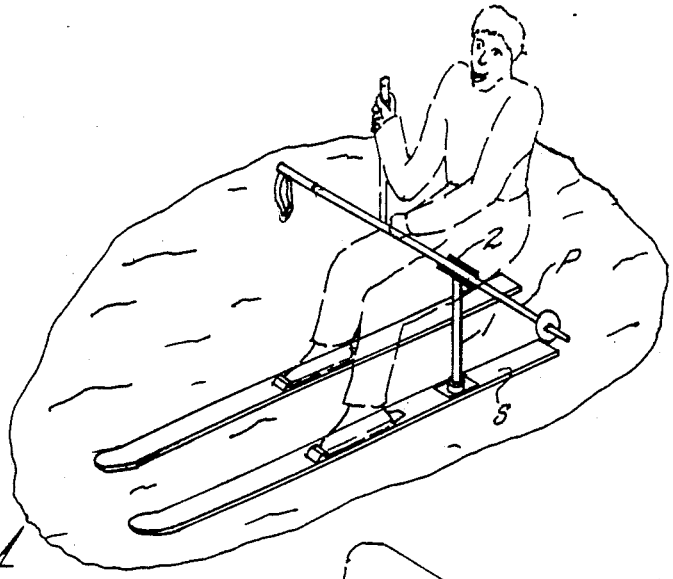
FIG. 1 is a perspective view of the present seat structure operatively disposed.

With continuing attention to the drawings wherein applied reference numerals indicate parts similarly hereinafter identified, the reference numeral 1 indicates a post of the present seat structure shown in temporary supported engagement on a ski S.

Figure 2:
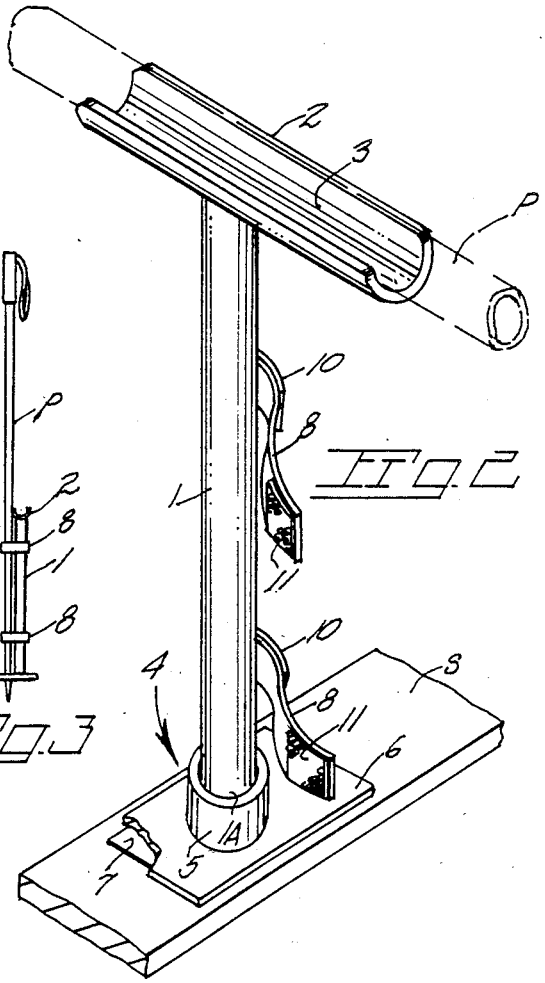
FIG. 2 is an enlarged perspective view of the present seat structure.

In place on the upper end of post 1 is a ski pole holder shown as a cross member 2 having a concave surface 3 (FIG. 2) on which a ski pole P may be temporarily supported in a horizontal manner. Cross member 2 may be secured to the end of post 1 by a weld extending about the post upper end. Retainer means are indicated generally at 4 and serve to removably couple the post lower end lA to the upper surface of ski S. A socket 5 of the retention means is in place on a base 6. To avoid alteration of the ski, a double sided adhesive sheet member 7 may be utilized which adheres to the ski and the underside of base 6.

Figure 3:
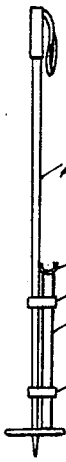
FIG. 3 is a side elevational view of a ski pole with the post of the present seat structure attached thereto.

In place on post 1 are straps 8 which provide coupling means for attaching the post to a ski pole P as shown in FIG. 3. The straps may be secured to post 1 in any suitable manner such as by rivets extending through the straps and the post wall. The straps are intended for wrapped engagement with the ski pole shaft and include cooperating fabric closure patches at 10 and 11 of hook and loop construction which allow secure attachment of post 1 to the pole shaft in a highly convenient manner.

Figure 4:
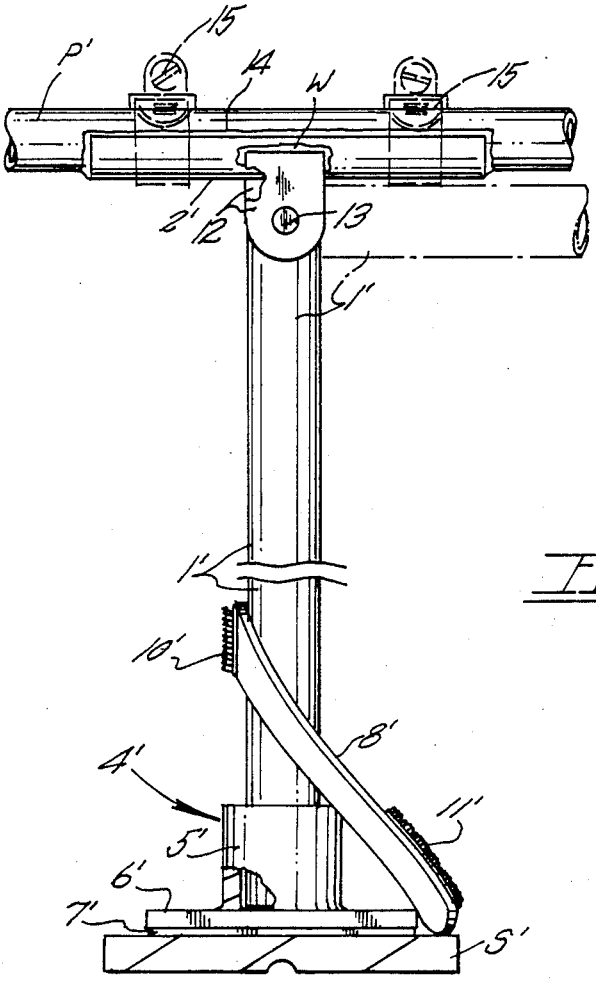
FIG. 4 is an elevational view of a modified form of the seat structure.

FIG. 4 discloses a somewhat modified seat structure wherein prime reference numerals indicate parts earlier identified by like base reference numerals. In the modified seat structure, a post 1' is swingably coupled by pivot means to a pole holder shown as a cross member at 2' by a clevis and pin arrangement at 12 and 13. Clevis ears are suitably secured as by welds as at W to a convex outer surface of cross member 2'. The cross member 2' is secured in place on the ski pole P' such as by a weld 14 or, if desired, by hose clamps 15 shown in phantom lines which permit transfer of the seat structure to a newly acquired ski pole. A strap 8' is suitably attached to post 1' and serves to retain the post in a collapsed parallel position shown in broken lines in FIG. 4 when the closure patches at 10' and 11' are fastened to one another.

For avoidance of injury, all corners of the present seat structure would be formed on a radius.

The operation of the present seat structure is believed obvious upon an understanding of the foregoing description. The seat structure may be deployed for use and subsequently stowed on the ski pole without requiring the user to remove ski gloves.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. Seat structure for attachment to a recreational ski to permit a ski pole to be used as a seat by a skier wearing the ski, said seat structure comprising, a post, retainer means for attachment to the upper surface of the ski for removably securing a lower end of said post to the ski in an upright manner, a cross member on said post having a surface on which the ski pole may be horizontally placed to position the ski pole above and crosswise of the ski to enable use of the pole as a seat by the skier while wearing the ski, and coupling means for attaching said post in parallel fashion to a ski pole to permit normal ski pole use during skiing.

2. The seat structure claimed in claim 1 wherein said retainer means includes a socket for reception of the lower end of said post.

3. The seat structure claimed in claim 2 wherein said retainer means includes a base plate and adhesive means for securing the base plate to the ski.

4. The seat structure claimed in claim 1 wherein said cross member is in pivotal engagement with said post.

5. The seat structure claimed in claim 1 wherein coupling means are straps each equipped with closure means for securement to the ski pole.

6. Seat structure for attachment to a recreational ski to permit a ski pole to be used as a seat and comprising, a post, retainer means for removably securing a lower end of said post to the upper surface of the ski, a cross member on said post and having a surface on which a ski pole may be horizontally positioned in a temporary manner to enable use of the pole as a seat by a skier wearing the ski, coupling means for attaching said post in a parallel fashion to a ski pole to permit normal use of the ski pole, and pivot means joining said cross member to said post to permit collapsing of the post into parallel relationship with a ski pole in said cross member.

7. The seat structure claimed in claim 6 wherein means securing said cross member to said ski pole is embodied in removable clamps.

8. The seat structure claimed in claim 6 wherein means securing said cross member to said ski pole is a weld.

* * * * *